US009027868B2

(12) United States Patent
Guerin

(10) Patent No.: US 9,027,868 B2
(45) Date of Patent: May 12, 2015

(54) COILED ROLL CONTAINER

(76) Inventor: Phillip M. Guerin, Lawrence, MA (US)

( * ) Notice: Subject to any disclaimer, the term of this patent is extended or adjusted under 35 U.S.C. 154(b) by 721 days.

(21) Appl. No.: 13/287,539

(22) Filed: Nov. 2, 2011

(65) Prior Publication Data

US 2013/0105615 A1 May 2, 2013

(51) Int. Cl.

| | |
|---|---|
| ***B65H 23/08*** | (2006.01) |
| ***E04D 15/06*** | (2006.01) |
| *B65H 16/00* | (2006.01) |

(52) U.S. Cl.

CPC ..... *E04D 15/06* (2013.01); *B65H 16/005* (2013.01); *B65H 2701/173* (2013.01)

(58) Field of Classification Search

USPC ..... 242/422, 422.4, 422.5, 422.6, 422.7, 242/422.8, 595

See application file for complete search history.

(56) References Cited

U.S. PATENT DOCUMENTS

| | | | | |
|---|---|---|---|---|
| 404,596 | A | 6/1889 | Caldwell | |
| 1,168,703 | A | 1/1916 | Bauer | |
| 1,981,590 | A * | 11/1934 | Easterling | 225/47 |
| 2,031,033 | A | 2/1936 | Denebeim | |
| 2,483,522 | A * | 10/1949 | Bovee | 281/6 |
| 3,166,187 | A | 1/1965 | Araujo | |
| 3,337,044 | A | 8/1967 | Smith et al. | |
| 3,796,305 | A | 3/1974 | Beason | |
| 3,856,141 | A | 12/1974 | Reed | |
| 3,982,712 | A | 9/1976 | Bassett | |
| 3,998,326 | A | 12/1976 | McKee, Jr. | |
| 4,034,926 | A | 7/1977 | Wegner | |
| 4,239,164 | A | 12/1980 | Barnsbee et al. | |
| 4,274,573 | A | 6/1981 | Finkelstein | |
| 4,467,974 | A * | 8/1984 | Crim | 242/419.4 |
| 4,805,794 | A | 2/1989 | Tsuchiya et al. | |
| 4,821,876 | A | 4/1989 | Naito et al. | |
| 4,826,015 | A | 5/1989 | Mandel | |
| 4,901,855 | A * | 2/1990 | Furukawa | 206/389 |
| 4,957,246 | A | 9/1990 | Kantor | |
| D313,752 | S | 1/1991 | Dyble | |
| 5,038,934 | A | 8/1991 | Higashiyama | |
| 5,284,247 | A | 2/1994 | Turner | |
| 5,819,935 | A | 10/1998 | Lawson | |
| 5,829,710 | A * | 11/1998 | Halle et al. | 242/595.1 |
| 5,867,969 | A | 2/1999 | Quinones | |
| 6,446,808 | B1 | 9/2002 | Paul et al. | |
| 6,530,473 | B1 | 3/2003 | St. Felix | |
| 7,306,100 | B1 | 12/2007 | Eslambolchi et al. | |
| D576,433 | S | 9/2008 | Che | |
| D613,982 | S | 4/2010 | Wilson et al. | |
| 2004/0004013 | A1 | 1/2004 | Dieter et al. | |

* cited by examiner

*Primary Examiner* — William A Rivera

(74) *Attorney, Agent, or Firm* — David M. Driscoll, Esq.

(57) ABSTRACT

A coiled roll container including a base having opposed one and other sides and an outlet slot through which an edge of the coil roll extends. A pair of elastic cords each having opposed one and other ends is provided with the one end fixed at one side of the base and the other end releasably attached to the other side of the base. The elastic cords are for looping over the coiled roll to secure the coiled roll in place. The container also includes a cord locking mechanism at the other side of the base for receiving and securing the elastic cords about the coil roll.

20 Claims, 13 Drawing Sheets

COILED ROLL CONTAINER

TECHNICAL FIELD

The present invention relates to containers, and pertains more particularly to an improved container construction that is particularly suited for supporting and dispensing roll material. Even more particularly the present invention relates to a container for supporting and dispensing a sheet metal roll.

BACKGROUND OF THE INVENTION

Sheet metal rolls are widely used in the construction business for a wide variety of applications including in the roofing field. These rolls are typically used, as is, with the result that the unused roll is found around the construction site in an unorganized manner. This also creates an unsafe situation in which sharp edges of the roll are exposed.

Accordingly, it is an object of the present invention to provide a dispensing container for a roll of sheet material, particularly metal sheet material.

Another object of the present invention is to provide a container for supporting and dispensing a sheet metal roll, and which is simple in construction, easy to use and can be made relatively inexpensively.

A further object of the present invention is to provide a roll container in which a particular method is used for the use of the container that allows ready insertion of the roll into the container, as well as ready dispensing of the sheet material from the roll.

SUMMARY OF THE INVENTION

In accordance with the present invention there is provided an apparatus for holding and dispensing a coil roll. This apparatus includes a base for receiving the coil roll, with the base having opposed one and other sides and having an outlet slot through which an edge of the coil roll extends. The apparatus further includes at least one elastic cord having opposed one and other ends with the one end fixed at one side of the base. The opposed other end of the elastic cord is releasably attached to the other side of the base. The elastic cord is for looping over the coil roll to secure the coil roll in place. The apparatus also includes a cord locking mechanism at the other side of the base for receiving and securing the elastic cord about the coil roll.

In accordance with other aspects of the present invention there may be provided a pair of base pieces disposed spaced apart on the base and forming a cradle for the coil roll; each of the base pieces has an arcuate surface upon which the coil roll rests; the arcuate surface of each base piece has a low friction surface to assist in withdrawing the roll edge; each base piece has a chamber with a hole leading to the chamber, said chamber receiving the one end of the elastic cord and the elastic cord formed into a knot that retains the elastic cord within the chamber; the locking mechanism comprises a locking sleeve or the locking mechanism comprises a locking ledge disposed along the other side of the base; a pair of elastic cords and wherein each base piece has a chamber into which the one end of each elastic cord is retained; each of the elastic cords is formed into a knot that retains the elastic cord within the chamber; the locking mechanism includes a separate locking sleeve that receives the other end of both elastic cords; the locking sleeve is tubular with the respective elastic cords entering the sleeve from opposed ends thereof; the locking sleeve has end slots that receive respective ends of the elastic cords; the respective elastic cords cross each other within the locking sleeve; alternatively the locking mechanism includes a locking ledge disposed along the other side of the base; the locking ledge includes a passage disposed along the other side of the base and for receiving an end of the associated elastic cord, and an aperture adjacent to passage and through which the end of the elastic cord extends; an arcuate surface disposed between the passage and aperture for reversing the direction of the elastic cord therebetween; a smaller width slot contiguous with the aperture and into which the end of the elastic cord is held; low friction pads disposed in the base along the other side of the base; spaced apart locking mechanisms for receiving respective elastic cords; and each locking ledge includes a passage disposed along the other side of the base and for receiving an end of the associated elastic cord, and an aperture adjacent to passage and through which the end of the elastic cord extends; including an arcuate surface disposed between the passage and aperture for reversing the direction of the elastic cord therebetween; and including a smaller width slot contiguous with the aperture and into which the end of the elastic cord is held.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to the drawings which illustrate two separate but related embodiments of the present invention. A first embodiment is illustrated in FIGS. 1-8, while a second embodiment is illustrated in FIGS. 9-15. In both of these embodiments, a coiled metal roll 10 is secured to a base 12. The base 12 can be constructed in various widths and lengths to accommodate a variety of different sizes of coiled metal rolls 10. In both embodiments described herein, the same reference numbers are used to identify like components.

Figure 1:
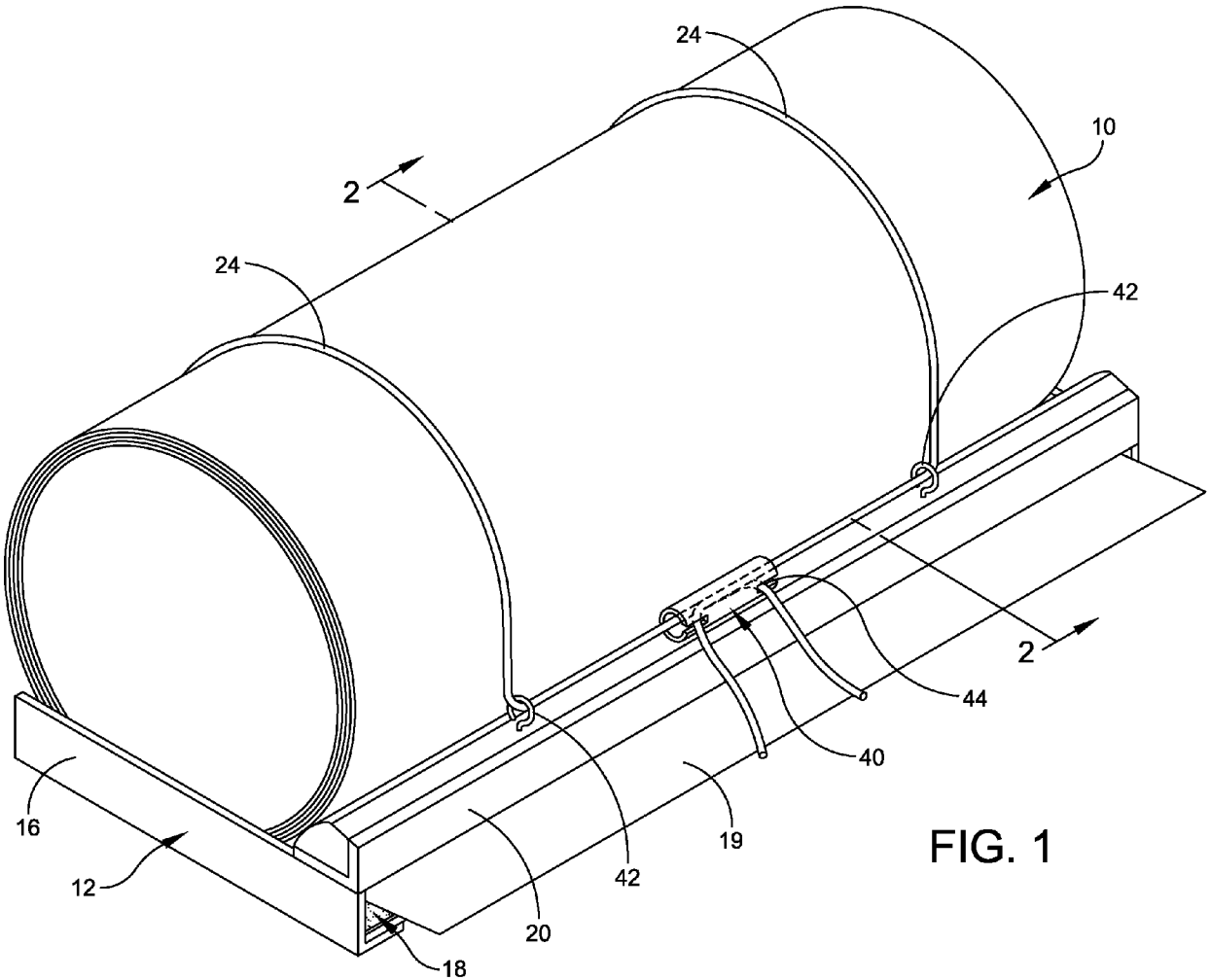
FIG. 1 is a perspective view of a first of two embodiments of the coiled roll container of the present invention.
Figure 2:
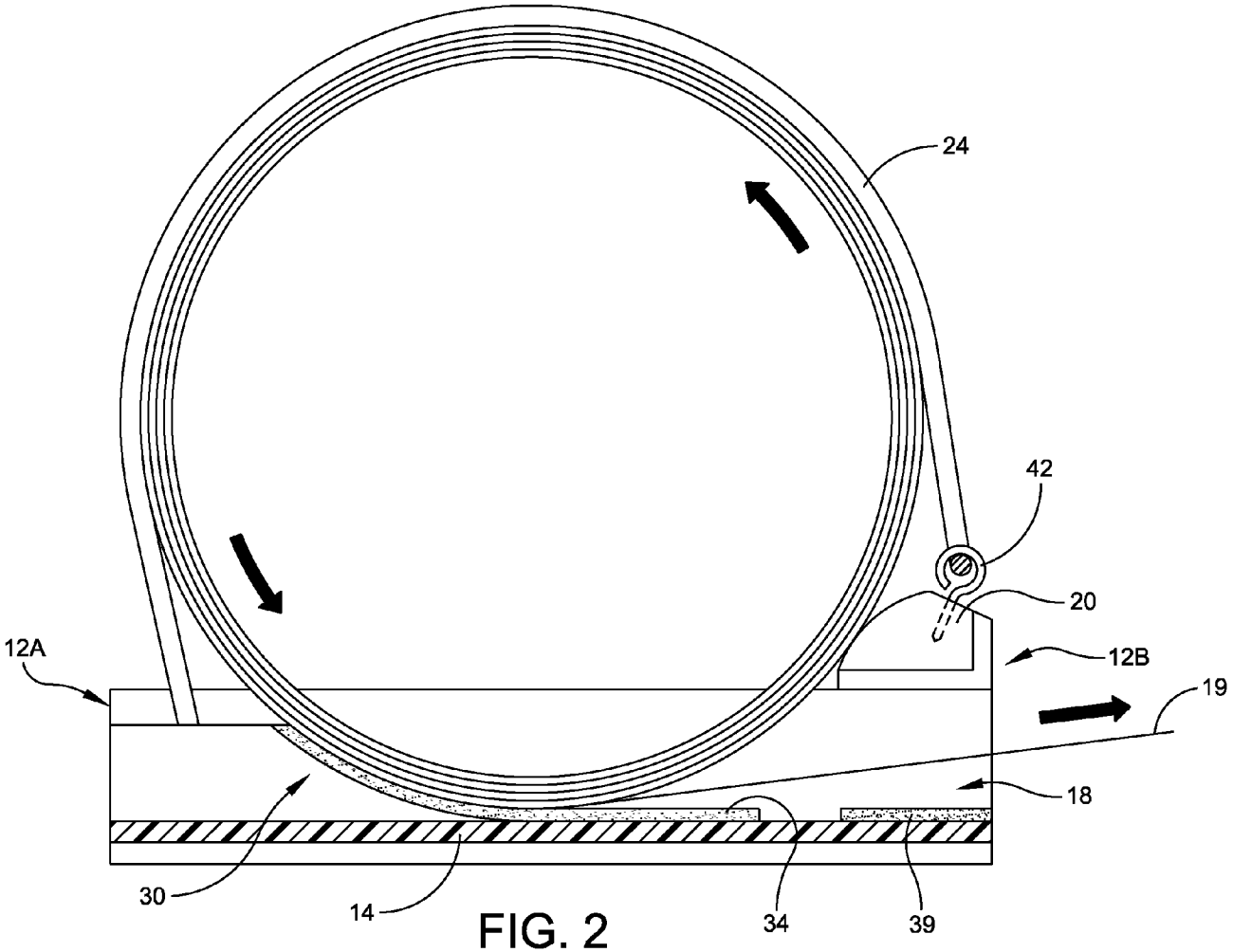
FIG. 2 is a cross-sectional view taken along line 2-2 of FIG. 1.
Figure 3:
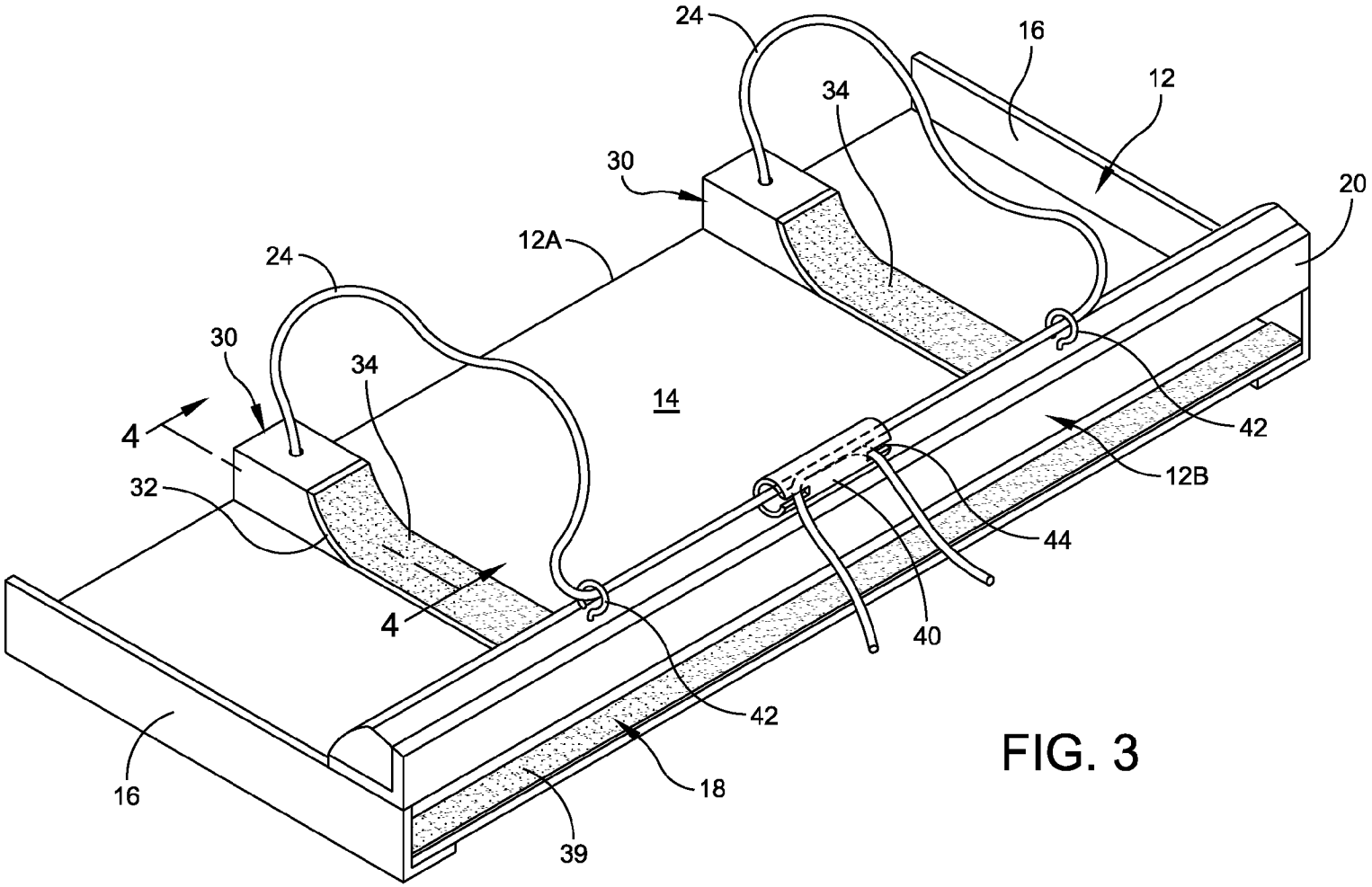
FIG. 3 is a perspective view of the coiled roll container of FIGS. 1 and 2 but with the metal roll removed.
Figure 4:
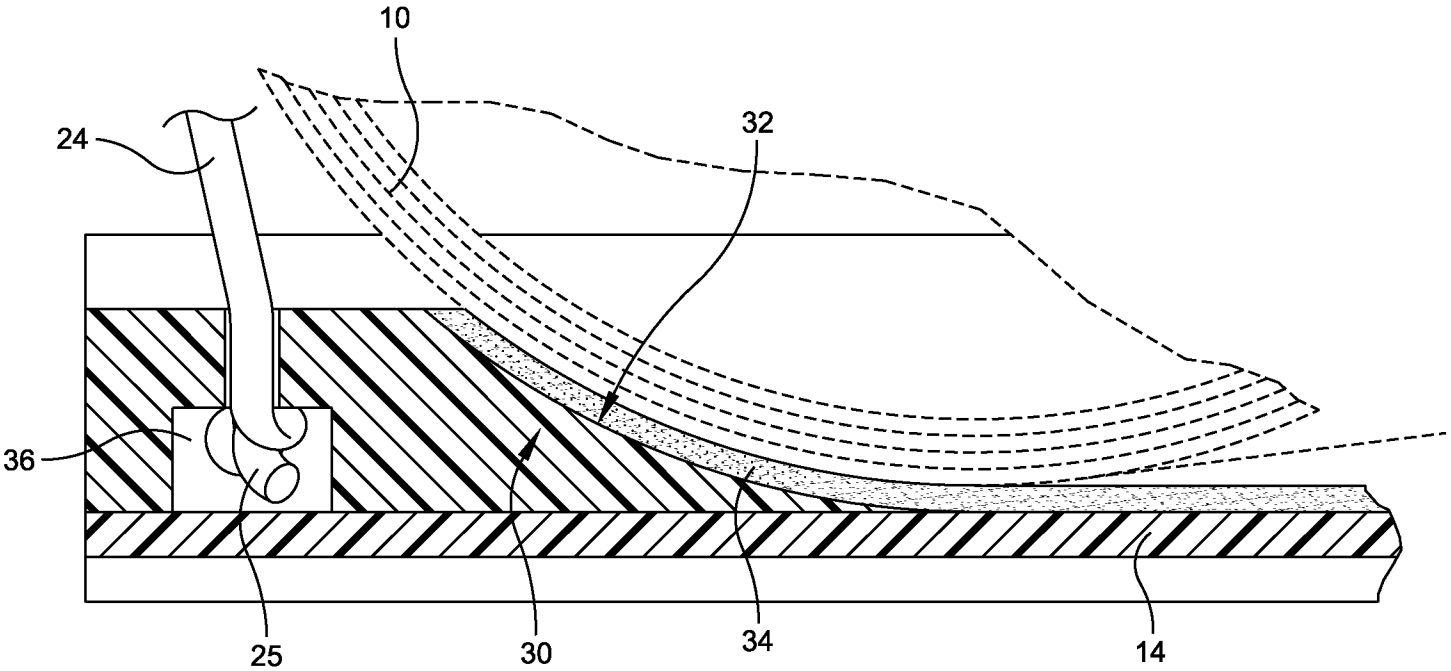
FIG. 4 is a fragmentary cross-sectional view taken along line 4-4 of FIG. 3.
Figure 5:
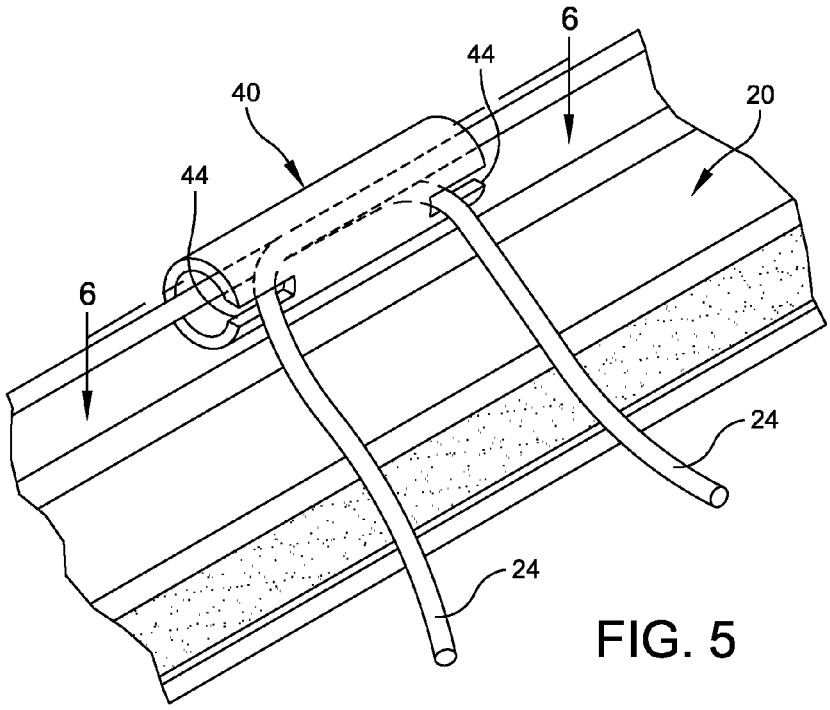
FIG. 5 is a perspective fragmentary view of the locking mechanism of the embodiment illustrated in FIGS. 1-4.
Figure 6:
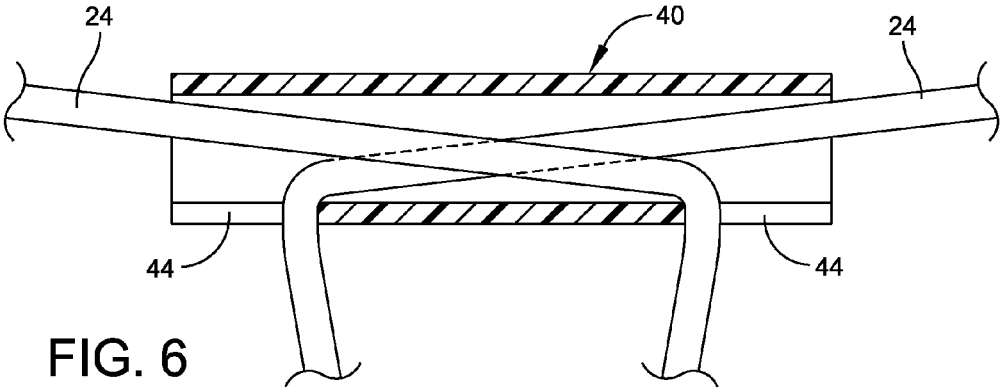
FIG. 6 is a cross-sectional view through the locking sleeve as taken along line 6-6 of FIG. 5.
Figure 7:
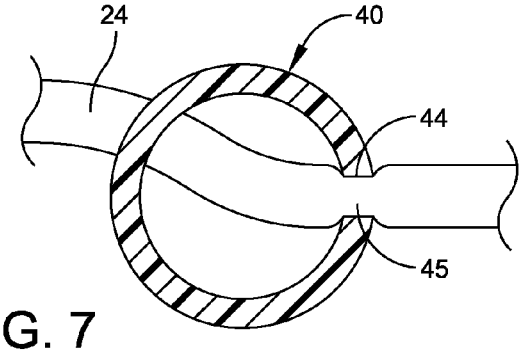
FIG. 7 is an enlarged fragmentary cross-sectional view illustrating the manner in which the cord locks in place.
Figure 9:
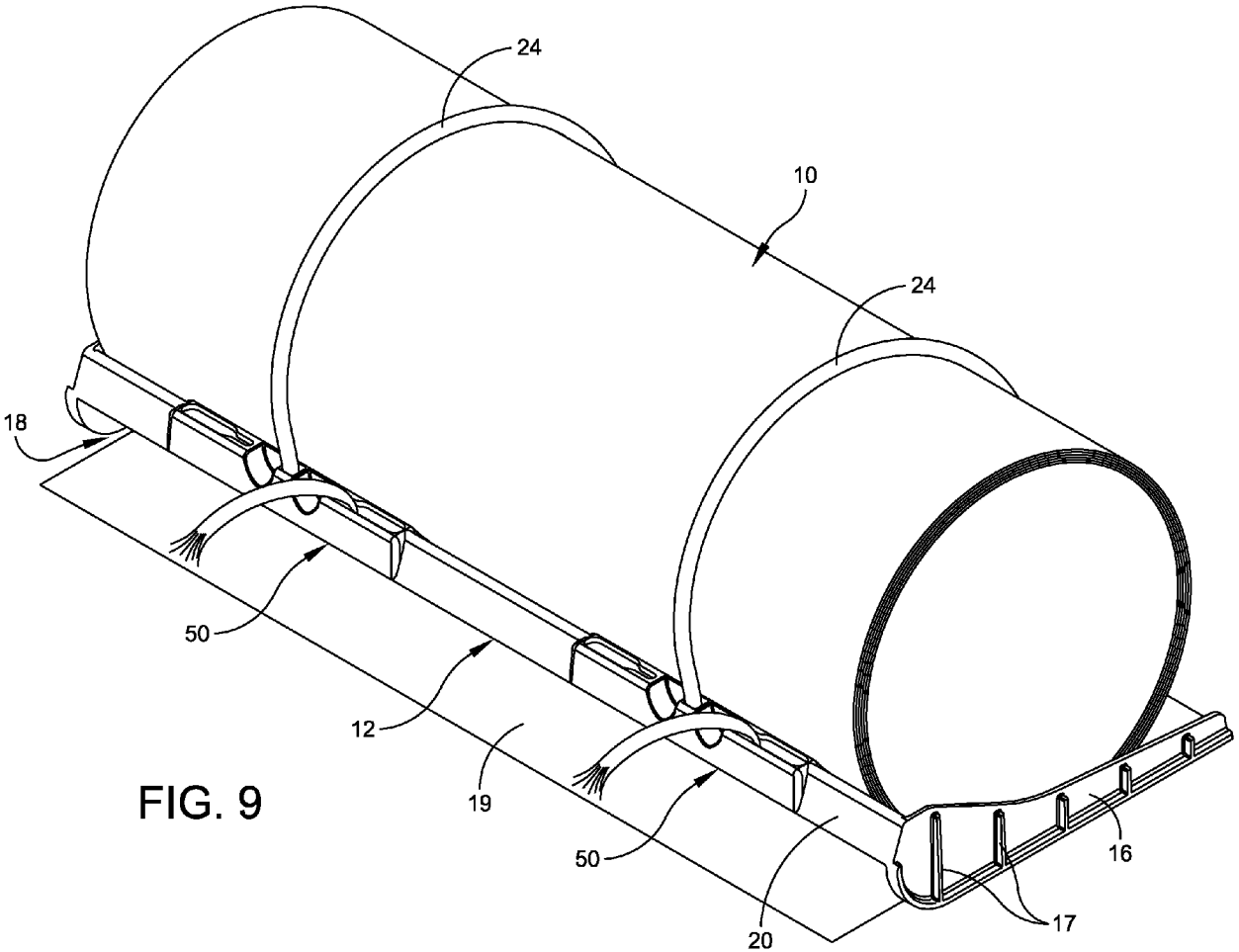
FIG. 9 is a perspective view of a second embodiment of the present invention.
Figure 10:
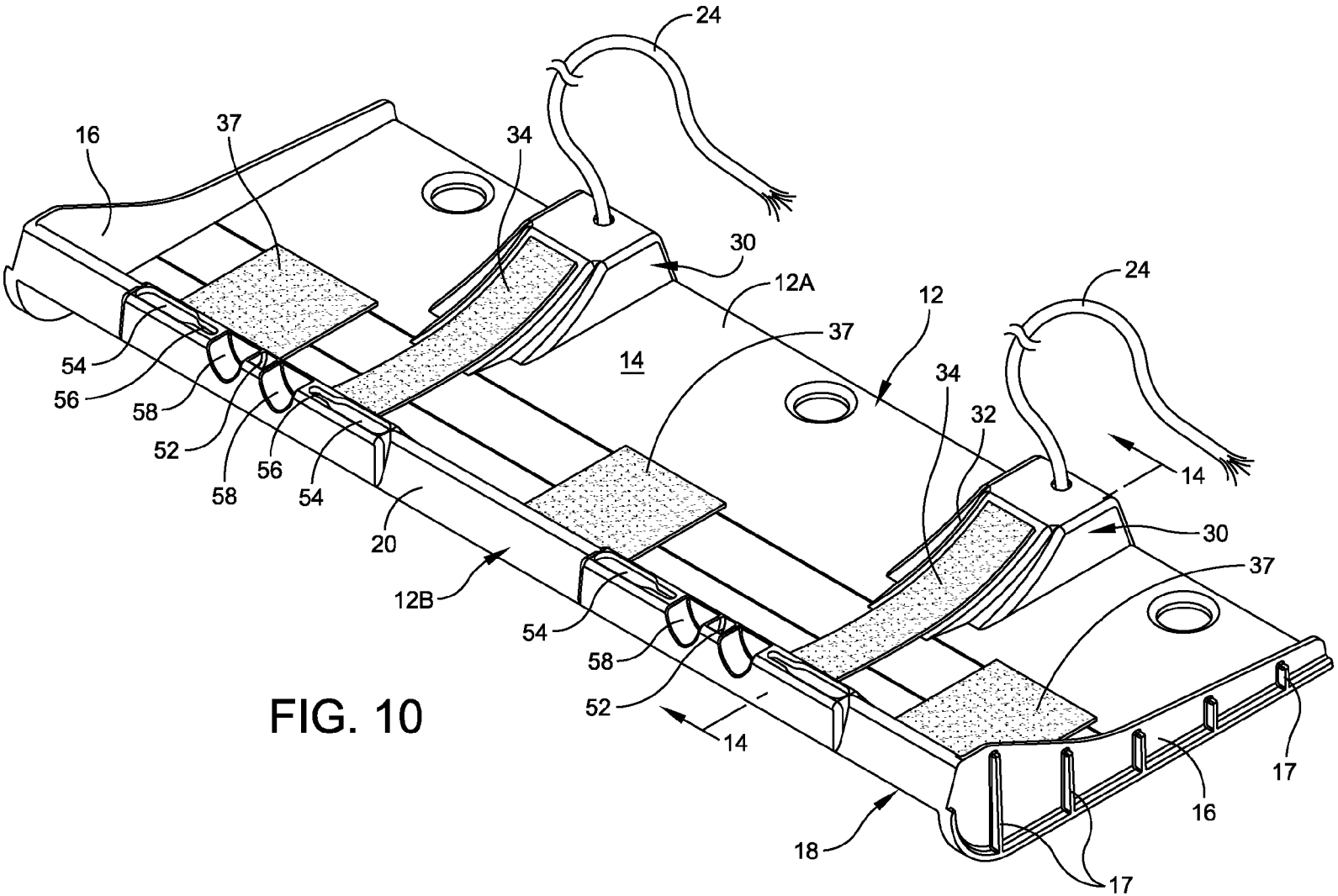
FIG. 10 is a perspective view of the embodiment of FIG. 9 but with the metal roll removed.

In both of the embodiments described herein, the base 10 may be constructed of a variety of different materials but preferably is constructed of a hard plastic material. Refer, for example, to FIG. 3 for details of the base 12 of the first embodiment and refer to FIG. 10 for details of the base 12 of the second embodiment. The base 12 has a substantially flat bottom 14 and respective end walls 16. The end walls 16 properly position the coiled metal roll. Refer, for example, to FIGS. 1 and 9 illustrating the metal roll 10 limited in its side to side movement by means of the walls 16. In the embodiment of FIG. 10, the end walls 16 are preferably provided with ribs 17 that enhance the strength of each of the end walls.

The base 12 is also provided with one and other sides 12A and 12B, as well as an elongated outlet slot 18 through which an edge 19 of the coiled roll extends. FIG. 1 illustrates the edge 19 extending through the slot 18 and similarly FIG. 9 illustrates the edge 19 extending through the slot 18. The side 12B of the base is defined primarily by the side wall 20. The side wall 20 has different configurations in the respective embodiments described herein. In the first embodiment, the locking mechanism is essentially separate from the side wall 20, while in the second embodiment described herein, the locking mechanism is formed as part of the side wall 20, to be described in further detail hereinafter.

In order to secure the coiled metal roll 10 in place, there is provided at least one elastic cord 24. Preferably, as illustrated in both embodiments described herein, there are a pair of elastic cords 24. Each of the cords 24 is also considered as having opposed one and other ends with the one end fixed at the side 12A of the base. The opposed other end of the elastic cord is releasably attached to the other side 12B of the base. The one side of the elastic cord 24 is illustrated in, for example, the fragmentary cross-sectional view of FIG. 4 attached to one of the base pieces by means of a knot 25. Thus, disposed on the bottom 14, are a pair of base pieces 30. Each of these base pieces is spaced apart and forms a cradle for the coiled metal roll. Thus, each of the base pieces has an arcuate surface 32. Also illustrated in the drawings herein disposed on this arcuate surface 32 is a low friction layer 34. The layer 34 may be appropriately secured to the arcuate surface such as with the use of an adhesive. As illustrated in, for example, FIGS. 4 and 14, each of the base pieces forms a chamber 36 in which the knot 25 is formed. Refer also to the cross-sectional view of FIG. 15 that shows the chamber 36, cord 24 and knot 25. In the cross-sectional views of FIGS. 14 and 15, associated with the base piece 30, it is noted that there are also provided reinforcing ribs 35. As also noted in FIG. 10, in the second embodiment, and in addition to the low friction strips 34, there may also be provided separately disposed low friction pads 37 disposed on the bottom 14. In the first embodiment, in place of the separate pads 37, there is one continuous low friction strip 39 that is used.

Thus, in both embodiments described herein, the one end of each of the elastic cords 24 is secured in place at the respective base pieces 30. The other end of each of the elastic cords is secured by means of a releasable locking mechanism. In the first embodiment of the invention described in FIGS. 1-8, the locking mechanism comprises a locking sleeve 40. In this embodiment of the invention, the respective elastic cords 24 are guided through respective hook eyes 42 and the other ends of the elastic cords pass through the sleeve 40 in a criss-cross manner. In this regard refer to the partial perspective view of FIG. 5 and the cross-sectional view of FIG. 6 that illustrate the respective elastic cords crossing within the sleeve 40. The sleeve 40 may be constructed of a relatively hard plastic material, is tubular and is provided with end slots 44.

Figure 8:
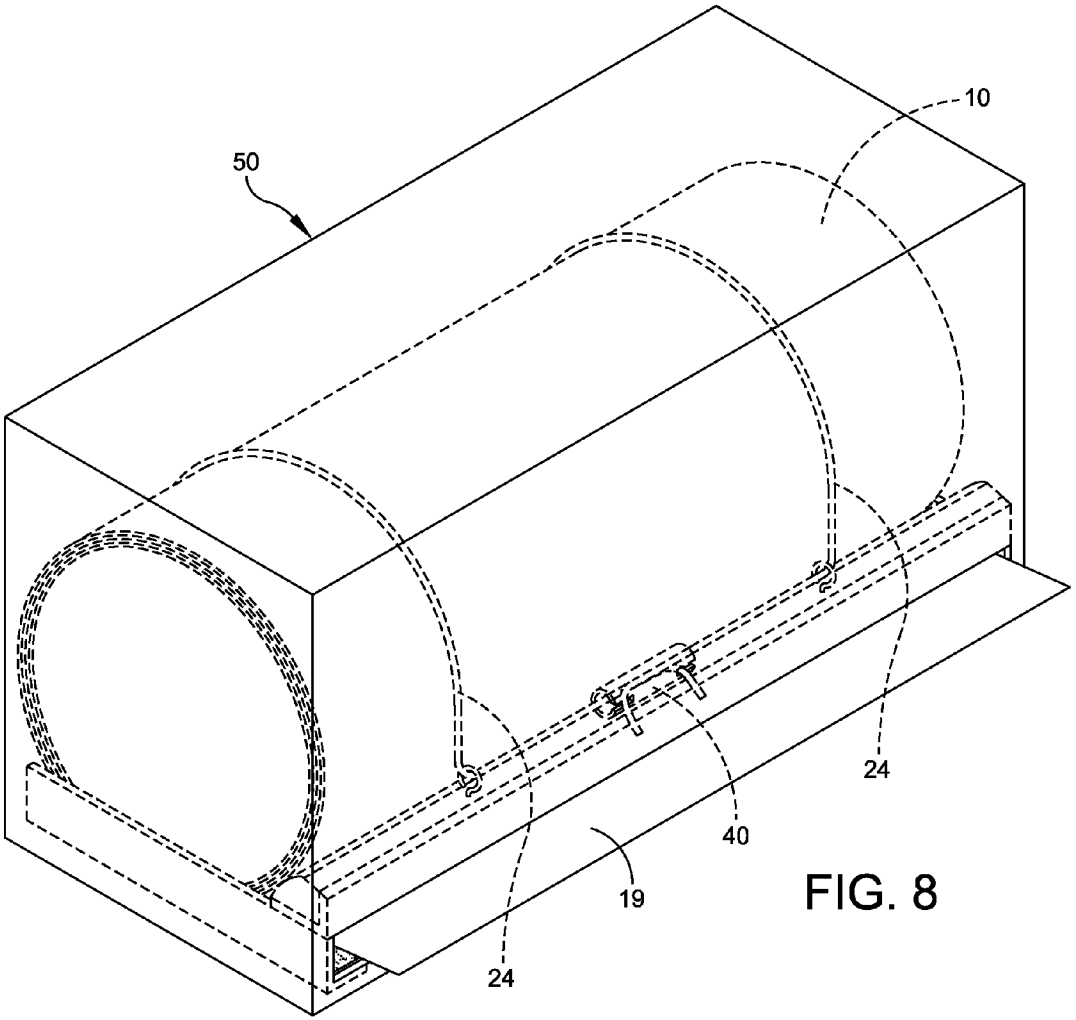
FIG. 8 is a perspective view similar to that illustrated in FIG. 1 in showing the coiled roll apparatus contained within a storage box.

The hook eyes 42 may be screwed into a top surface of the side wall 20 and preferably are arranged so that the elastic cord 24 makes a right hand turn as it is lead from the portion thereof that extends about the roll into the locking sleeve 40. Each of the slots 44 is dimensioned so that the width of the slot is slightly smaller than the diameter of the elastic cord. In that way the elastic cord becomes pinched as illustrated at 45 in FIG. 7. Each of the respective ends of the elastic cords are passed through the slot 44 and maybe pulled in opposite directions to tightly hold each of the elastic cords 24 about the coiled metal roll 10. There is essentially a force fit between each of the elastic cords and the respective slots 44. FIG. 8 illustrates an embodiment in which the container may be disposed in an outer box 50 also having a slot for receiving the edge 19 of the roll of coiled material.

Figure 11:
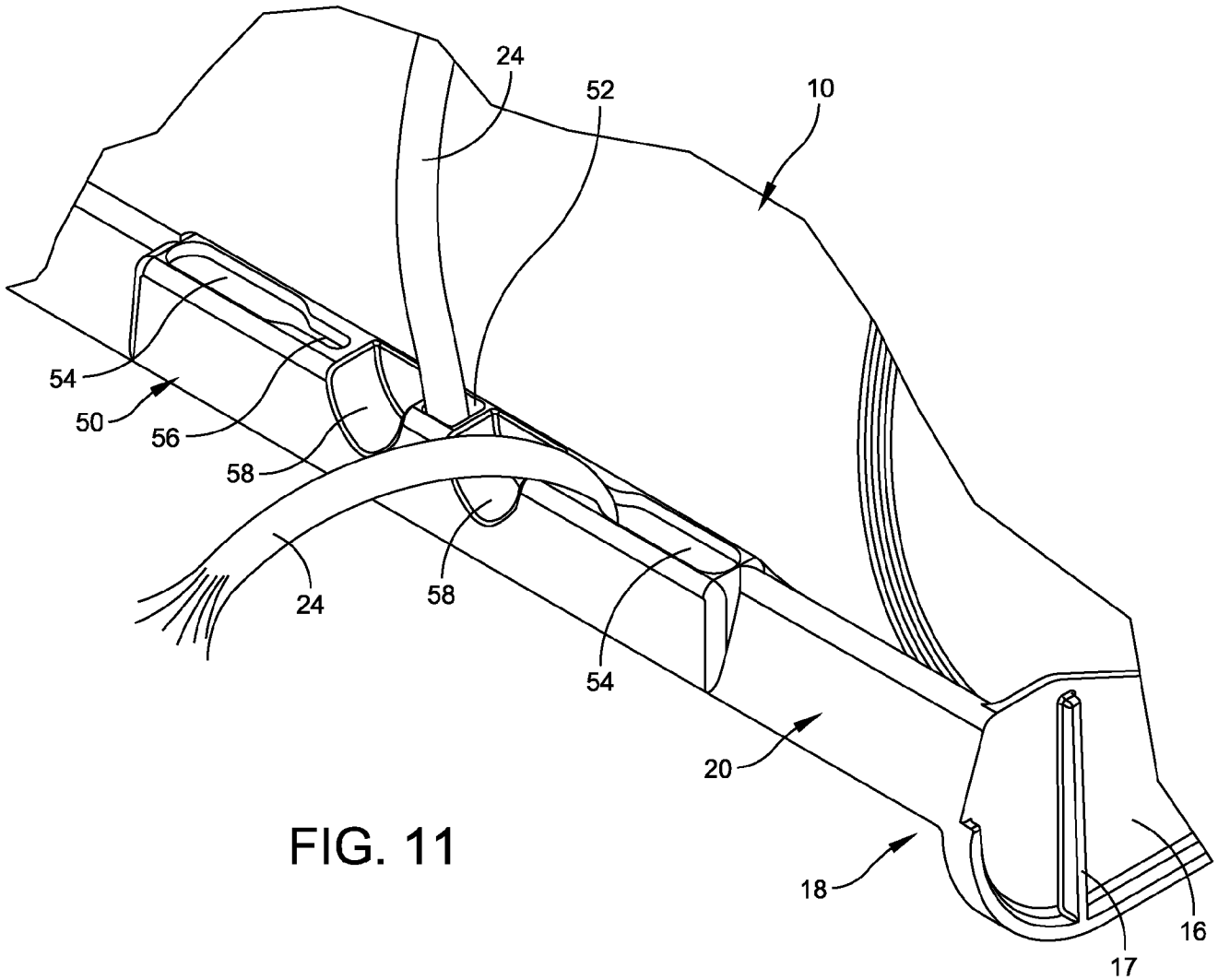
FIG. 11 is a fragmentary perspective view of the locking mechanism used in the embodiment of FIGS. 9 and 10.
Figure 12:
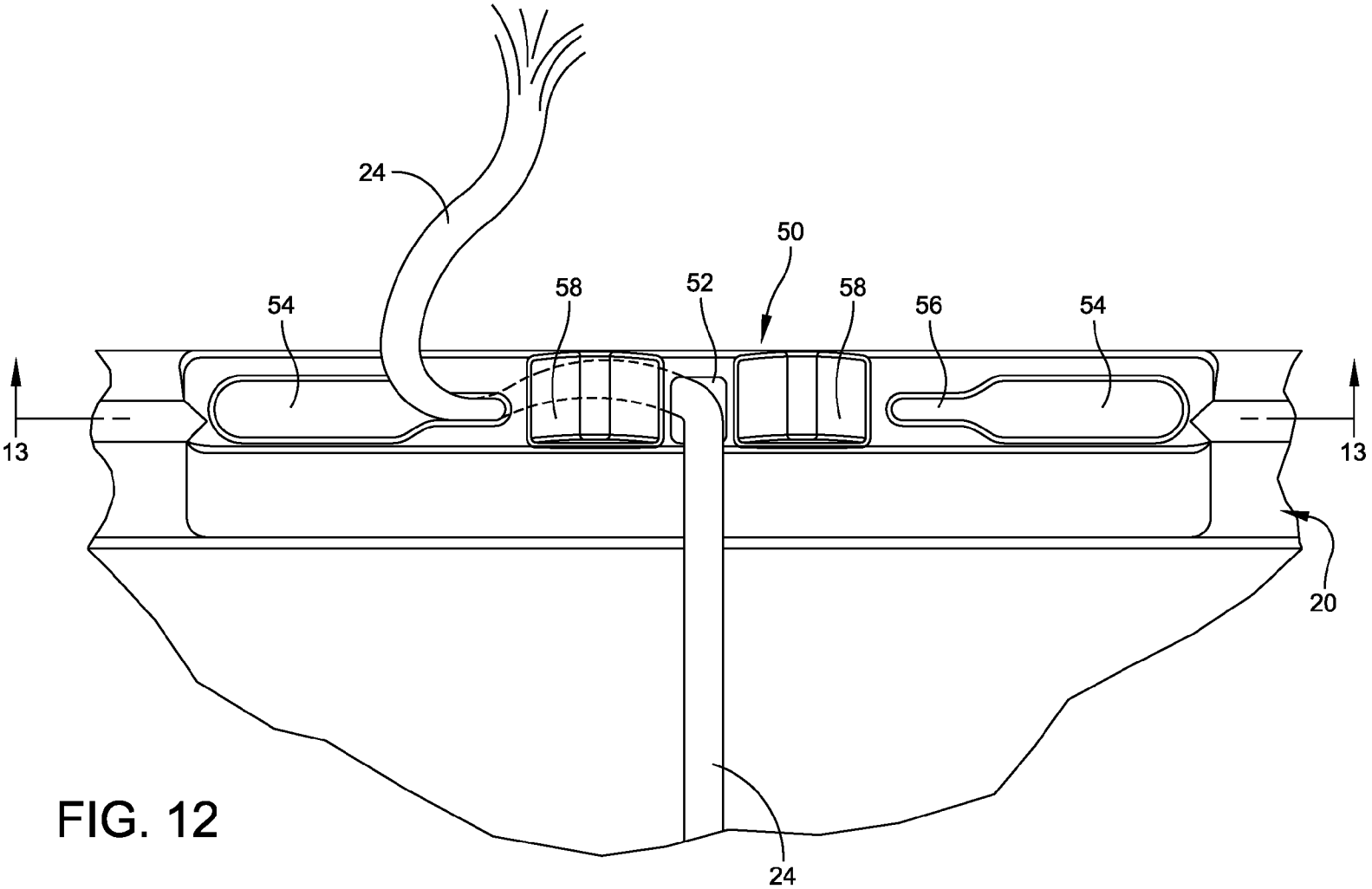
FIG. 12 is a fragmentary plan view at the locking mechanism.
Figure 13:
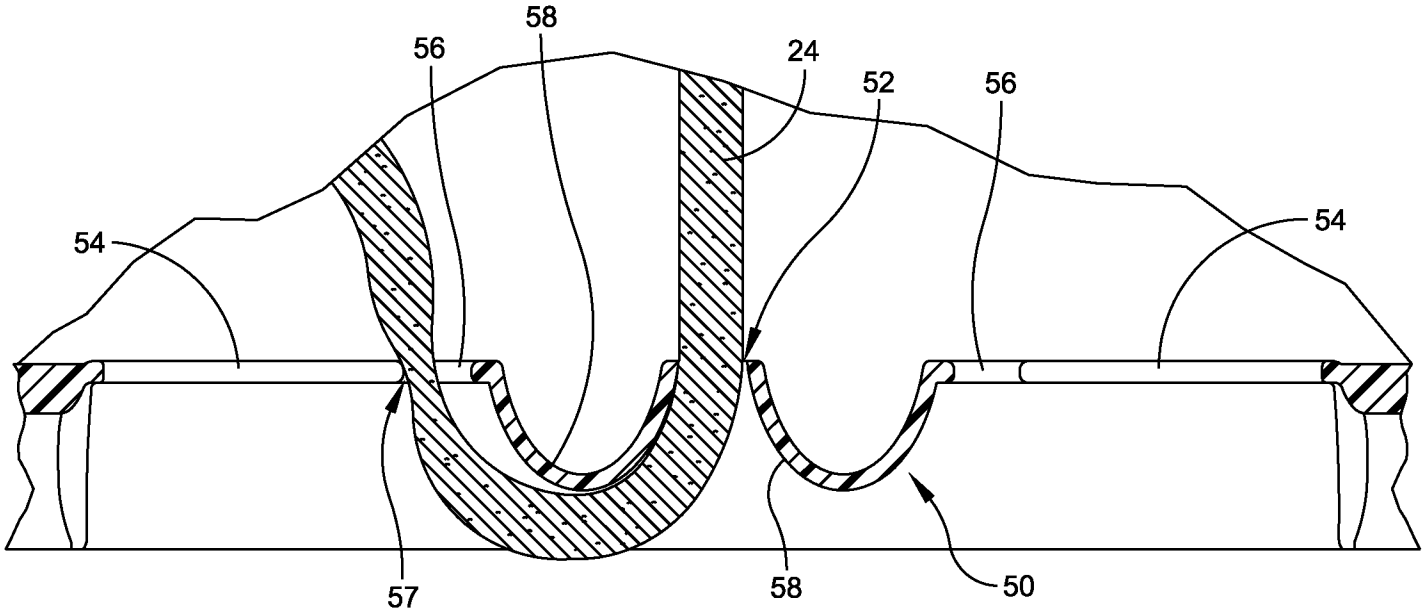
FIG. 13 is a cross-sectional view taken along line 13-13 of FIG. 12.
Figure 14:
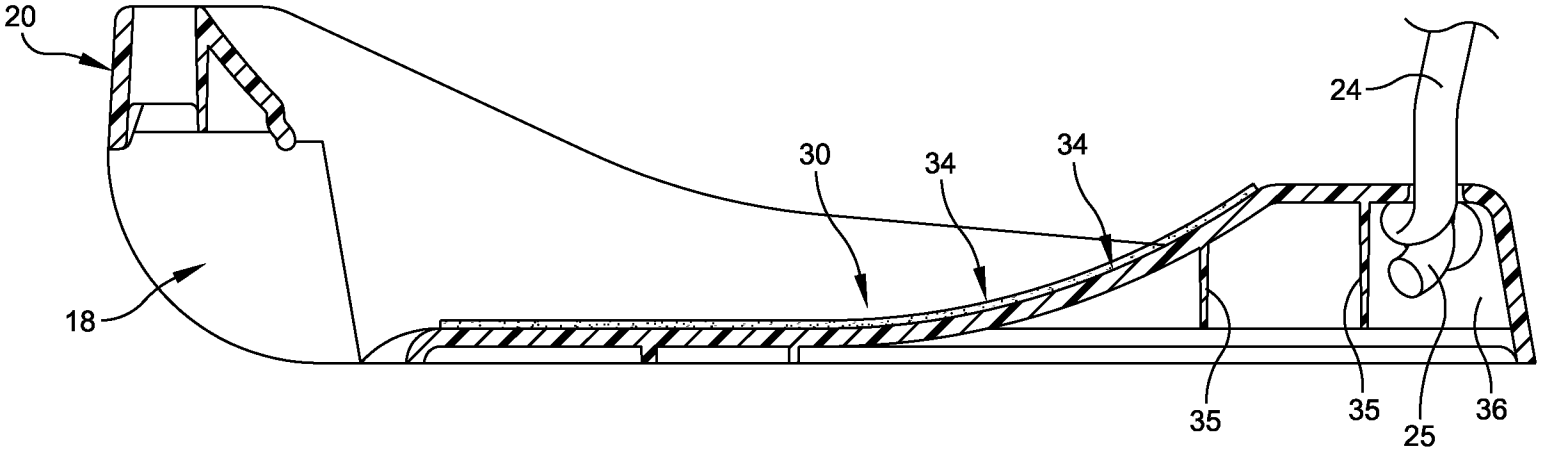
FIG. 14 is a cross-sectional view taken alone line 14-14 of FIG. 10.
Figure 15:
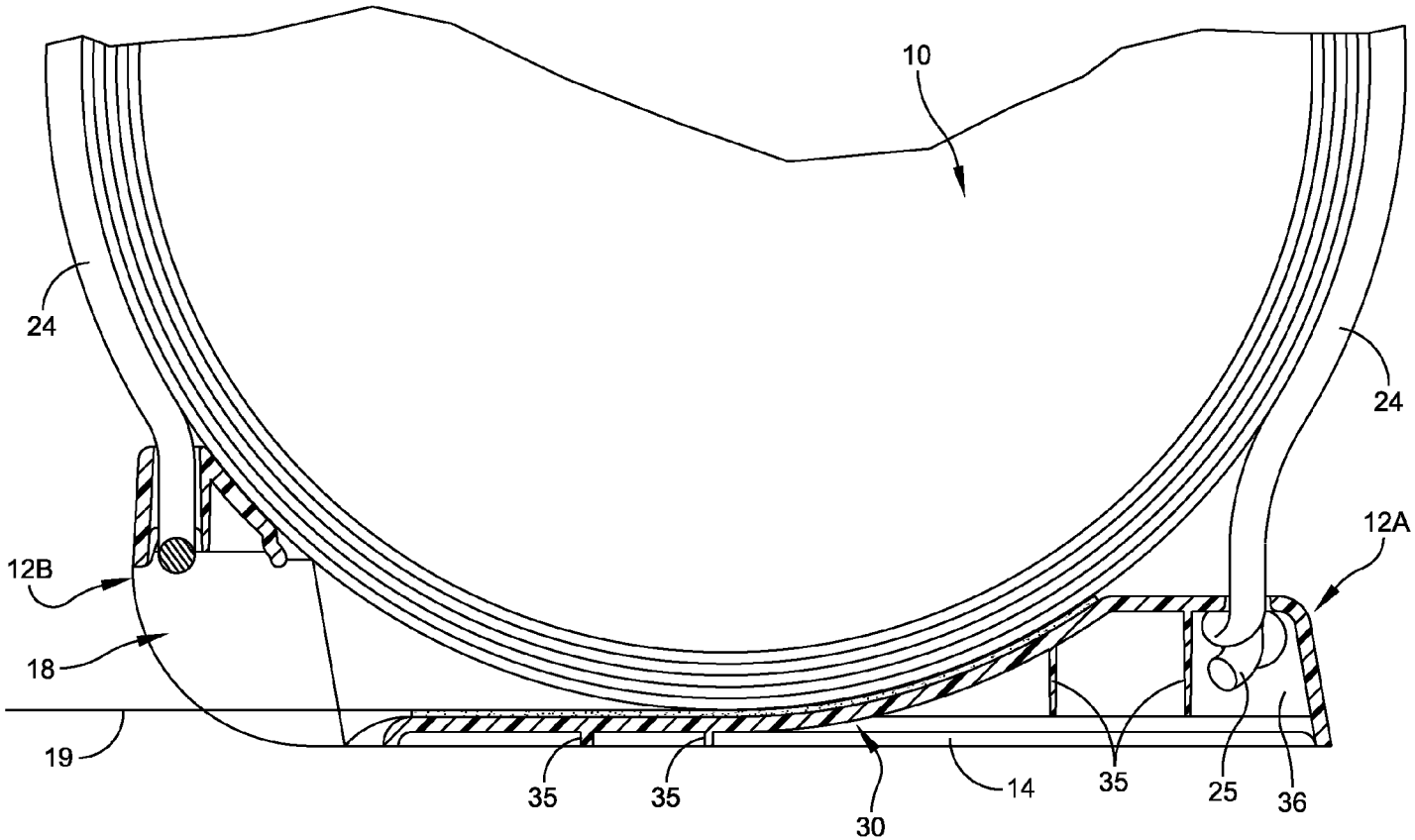
FIG. 15 is a cross-sectional view like that illustrated in FIG. 14 but additionally illustrating the position of the coiled metal roll.

In the second embodiment of the invention illustrated in FIGS. 9-15, the locking mechanism comprises a locking ledge disposed along the other side of the base 12, where, in the preferred arrangement, a pair of elastic cords are used, there are separate locking ledges 50 formed as part of the continuous side wall 20. Each of these respective ledges, is considered as integral with the side wall 20. FIG. 9 illustrates each of the elastic cords 24 extending into a passage 52 of each of the ledges 50. The passage 52 may be considered as disposed substantially centrally of the ledge section 50. On either side of the passage 52 there are provided apertures 54 each having facing smaller width slots 56. Refer to FIGS. 10-12. Between each slot 56 and the center passage 52 there are provided concave walls 58. These walls 58 define an arcuate curvature for essentially reversing the direction of the ends of the elastic cords 24. FIG. 13 illustrates the elastic cord 24 passing through the passage 52 about the wall 58 and engaged with the aperture 54 and, in particular, engaged with the smaller width slot 56 which is contiguous with the aperture 54. The width of the slot 56 is preferably smaller than the diameter of the elastic cord so that the elastic cord, once pulled into the slot 56, is pinched in place such as illustrated at 57 in FIG. 13.

In this second embodiment of the invention, the locking mechanism can be operated by pulling on the free end of the elastic cord so as to secure the elastic cord about the coiled metal roll. After the elastic cord is taut about the coiled metal roll, the very end of the elastic cord is then moved into the slot 56 and is secured in the slot by the interference fit between the elastic cord and the slot 56. It is noted that apertures are provided on both sides of the passage 52 so that the elastic cord may be locked in either position. In FIG. 13 it is illustrated as locked into the left aperture. However, it could just as easily be locked into the right aperture, as in FIG. 11.

In the embodiments shown herein the edge of the sheet material can be easily grasped in order to withdraw a length of material. Also, the coiled sheet material can be readily rolled backwards into the container as the roll is free to rotate in a reverse direction. In this way when one is through with withdrawing a length of material the roll end can be easily rolled backwards for storage in the container. In that way there is no risk of someone cutting themselves on an exposed edge of the roll.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An apparatus for holding and dispensing a coil roll, said apparatus comprising:

a base for receiving the coil roll, said base having opposed one and other sides and having an outlet slot through which an edge of the coil roll extends;

at least one elastic cord having opposed one and other ends with the one end fixed at one side of the base;

the opposed other end of the elastic cord being releasably attached to the other side of the base;

the elastic cord for looping over the coil roll to secure the coil roll in place; and a cord locking mechanism at the other side of the base for receiving and securing the elastic cord about the coil roll;

wherein the cord locking mechanism includes a separate locking sleeve that receives the other end of the at least one elastic cords.

2. The apparatus of claim 1 including a pair of base pieces disposed spaced apart on the base and forming a cradle for the coil roll.

3. The apparatus of claim 2 wherein each of the base pieces has an arcuate surface upon which the coil roll rests.

4. The apparatus of claim 3 wherein the arcuate surface of each base piece has a low friction surface to assist in withdrawing the roll edge.

5. An apparatus for holding and dispensing a coil roll, said apparatus comprising:

a base for receiving the coil roll, said base having opposed one and other sides and having an outlet slot through which an edge of the coil roll extends;

at least one elastic cord having opposed one and other ends with the one end fixed at one side of the base;

the opposed other end of the elastic cord being releasable attached to the other side of the base;

the elastic cord for looping over the coil roll to secure the coil roll in place; and a cord locking mechanism at the other side of the base for receiving and securing the elastic cord about the coil roll;

wherein said base has a chamber with a hole leading to the chamber, said chamber receiving the one end of the elastic cord and the elastic cord formed into a knot that retains the elastic cord within the chamber.

6. The apparatus of claim 5 wherein the locking mechanism comprises a locking sleeve.

7. The apparatus of claim 6 wherein the locking sleeve has an end slot for receiving the at least one elastic cord.

8. An apparatus for holding and dispensing a coil roll, said apparatus comprising:

a base for receiving the coil roll said base having opposed one and other sides and having an outlet slot through which an edge of the coil roll extends;

at least one elastic cord having opposed one and other ends with the one end fixed at one side of the base;

the opposed other end of the elastic cord being releasably attached to the other side of the base.

the elastic cord for looping over the coil roll to secure the coil roll in place; and a cord locking mechanism at the other side of the base for receiving and securing the elastic cord about the coil roll;

said base including a pair of base pieces disposed spaced apart on the base and forming a cradle for the coil roll; and a pair of elastic cords and wherein each base piece has a chamber into which the one end of each elastic cord is retained.

9. The apparatus of claim 8 wherein each of the elastic cords is formed into a knot that retains the elastic cord within the chamber.

10. An apparatus for holding and dispensing a coil roll, said apparatus comprising:

a base for receiving the coil roll, said base having opposed one and other sides and having an outlet slot through which an edge of the coil roll extends;

a pair of elastic cords each having opposed one and other ends with the one end fixed at one side of the base;

the opposed other end of each elastic cord being releasably attached to the other side of the base:

the elastic cord for looping over the coil roll to secure the coil roll in place; and a cord locking mechanism at the other side of the base for receiving and securing the elastic cord about the coil roll:

wherein the cord locking mechanism includes a separate locking sleeve that receives the other end of both elastic cords.

11. The apparatus of claim 10 wherein the locking sleeve is tubular with the respective elastic cords entering the sleeve from opposed ends thereof.

12. The apparatus of claim 11 wherein the locking sleeve has end slots that receive respective ends of the elastic cords.

13. The apparatus of claim 12 wherein the respective elastic cords cross each other within the locking sleeve.

14. An apparatus for holding and dispensing a coil roll, said apparatus comprising:

a base for receiving the coil roll, said base having opposed one and other sides and having an outlet slot through which an edge of the coil roll extends;

at least one elastic cord having opposed one and other ends with the one end fixed at one side of the base;

the opposed other end of the elastic cord being releasably attached to the other side of the base;

the elastic cord for looping over the coil roll to secure the coil roll in place; and a cord locking mechanism at the other side of the base for receiving and securing the elastic cord about the coil roll;

wherein the locking mechanism includes a locking ledge disposed along the other side of the base.

15. The apparatus of claim 14 wherein the locking ledge includes a passage disposed along the other side of the base and for receiving an end of the associated elastic cord, and an aperture adjacent to passage and through which the end of the elastic cord extends.

16. The apparatus of claim 15 including an arcuate surface disposed between the passage and aperture for reversing the direction of the elastic cord therebetween.

17. The apparatus of claim 16 including a smaller width slot contiguous with the aperture and into which the end of the elastic cord is held.

18. The apparatus of claim 14 including low friction pads disposed in the base along the other side of the base, and wherein the other base side is provided with a pair of apertures disposed on opposed sides of the passage enabling the cord end to interlock with an aperture on either side of the passage, both of the apertures having a smaller width slot contiguous with the aperture and into which the end of the elastic cord is held.

19. The apparatus of claim 14 including a pair of elastic cords and spaced apart locking mechanisms for receiving respective elastic cords.

20. The apparatus of claim 19 wherein each locking ledge includes a passage disposed along the other side of the base and for receiving an end of the associated elastic cord, and an aperture adjacent to passage and through which the end of the elastic cord extends;

including an arcuate surface disposed between the passage and aperture for reversing the direction of the elastic cord therebetween; and including a smaller width slot contiguous with the aperture and into which the end of the elastic cord is held.

* * * * *